US005621645A

United States Patent [19]

Brady

[11] Patent Number: 5,621,645

[45] Date of Patent: Apr. 15, 1997

[54] AUTOMATED LANE DEFINITION FOR MACHINE VISION TRAFFIC DETECTOR

[75] Inventor: Mark J. Brady, Cottage Grove, Minn.

[73] Assignee: Minnesota Mining and Manufacturing Company, St. Paul, Minn.

[21] Appl. No.: 377,711

[22] Filed: Jan. 24, 1995

[51] Int. Cl.[6] ..... G08G 1/04

[52] U.S. Cl. ..... 364/436; 364/460; 364/461; 340/903; 348/118

[58] Field of Search ..... 364/424.02, 460, 364/461, 436; 180/167, 168, 169; 348/113, 116, 118, 135, 139; 340/901, 903; 318/587

[56] References Cited

U.S. PATENT DOCUMENTS

| | | | |
|---|---|---|---|
| 4,573,547 | 3/1986 | Yoshimura et al. | 180/168 |
| 4,819,169 | 4/1989 | Saitoh et al. | 364/424.02 |
| 4,847,772 | 7/1989 | Michalopoulos et al. | 364/436 |
| 4,862,047 | 8/1989 | Suzuki et al. | 318/587 |
| 4,868,752 | 9/1989 | Fujii et al. | 364/424.02 |
| 4,970,653 | 11/1990 | Kenue | 364/461 |
| 5,142,592 | 8/1992 | Moler | 382/22 |
| 5,257,355 | 10/1993 | Akamatsu | 395/142 |
| 5,301,115 | 4/1994 | Nouso | 364/424.02 |
| 5,318,143 | 6/1994 | Parker et al. | 364/424.02 |
| 5,341,437 | 8/1994 | Nakayama | 364/424.02 |
| 5,351,044 | 9/1994 | Mathur et al. | 348/135 |
| 5,487,116 | 1/1996 | Nakano et al. | 364/460 |
| 5,517,412 | 5/1996 | Unoura | 364/461 |

FOREIGN PATENT DOCUMENTS

| | | |
|---|---|---|
| 0403193A3 | 6/1990 | European Pat. Off. . |
| 0505858A1 | 3/1992 | European Pat. Off. . |

OTHER PUBLICATIONS

Michalopoulos, P.G., "Vehicle Detection Video Through Image Processing: The Autoscope System"; IEEE Transactions on Vehicular Technology, vol. 40, No. 1, Feb., 1991; pp. 21–29.

Kelly, D., "Results of a Field Trial of the Impacts Image Processing Systems for Traffic Monitoring"; Vehicle Navigation and Information Systems Conference Proceedings P–253; 1991; pp. 151–167.

Kilger, M., "Video–Based Traffic Monitoring"; International Conference on Image Processing and its Application; 1992; pp. 89–92.

Toal, A.F. et al.; "Spatio–temporal Reasoning within a Traffic Surveillance System"; Computer Vision—Second European Conference on Computer Vision Proceedings; 1992; pp. 884–892.

*Primary Examiner*—Gary Chin
*Attorney, Agent, or Firm*—Gary L. Griswold; Walter N. Kirn; Kari H. Bartingale

[57] ABSTRACT

A method and apparatus defines boundaries of the roadway and the lanes therein from images provided by video. The images of the roadway are analyzed by measuring motion between images and detecting edges within motion images to locate edges moving parallel to the motion of the objects, such as vehicles, thereby defining the approximate boundaries of a lane or roadway. A curve is then generated based on the approximate boundaries to define the boundaries of the lane or roadway.

10 Claims, 6 Drawing Sheets

FIG.6
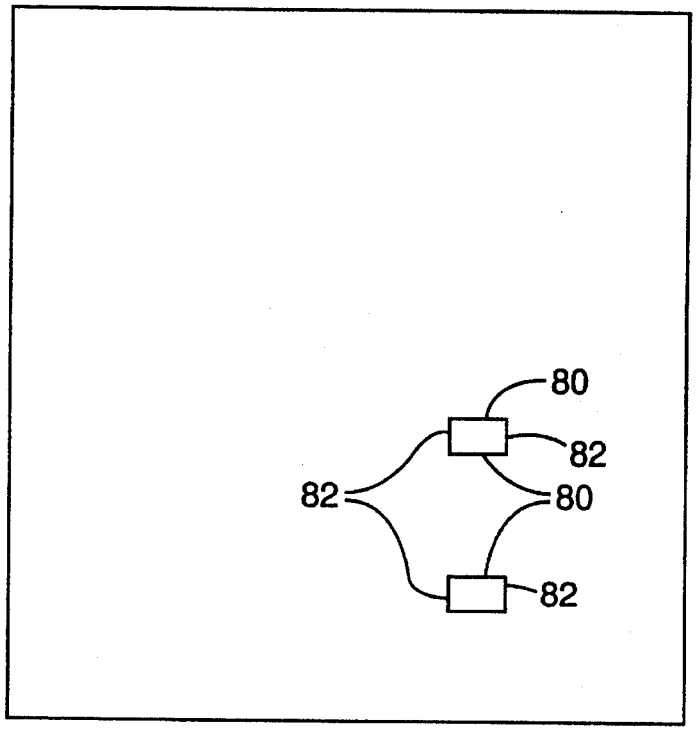
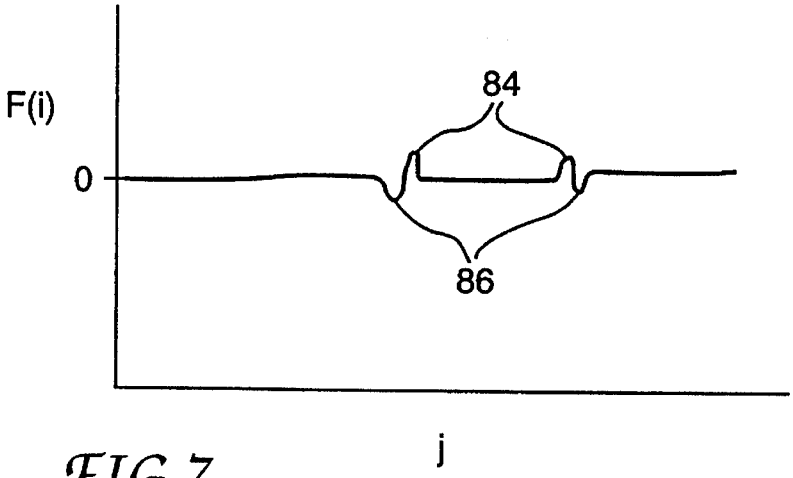
FIG.7
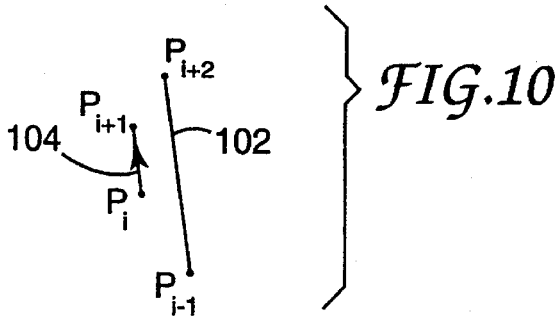
FIG.10

AUTOMATED LANE DEFINITION FOR MACHINE VISION TRAFFIC DETECTOR

FIELD OF THE INVENTION

The present invention relates generally to systems used for traffic detection, monitoring, management, and vehicle classification and tracking. More particularly, this invention relates to a method and apparatus for defining boundaries of the roadway and the lanes therein from images provided by real-time video from machine vision.

BACKGROUND OF THE INVENTION

With the volume of vehicles using roadways today, traffic detection and management has become ever important. Advanced traffic control technologies have employed machine vision to improve the vehicle detection and information extraction at a traffic scene over previous point detection technologies, such as loop detectors. Machine vision systems typically consist of a video camera overlooking a section of the roadway and a processor that processes the images received from the video camera. The processor then detects the presence of a vehicle and extracts other traffic related information from the video image.

An example of such a machine vision system is described in U.S. Pat. No. 4,847,772 to Michalopoulos et al., and further described in Panos G. Michalopoulos, *Vechicle Detection Video Through Image Processing: The Autoscope System,* IEEE Transactions on Vehicular Technology, Vol. 40, No. 1, February 1991. The Michalopoulos et al. patent discloses a video detection system including a video camera for providing a video image of the traffic scene, means for selecting a portion of the image for processing, and processor means for processing the selected portion of the image.

Before a machine vision system can perform any traffic management capabilities, the system must be able to detect vehicles within the video images. An example of a machine vision system that can detect vehicles within the images is described in commonly-assigned U.S. patent application Ser. No. 08/163,820 to Brady et al., filed Dec. 8, 1993, entitled "Method and Apparatus for Machine Vision Classification and Tracking." The Brady et al. system detects and classifies vehicles in real-time from images provided by video cameras overlooking a roadway scene. After images are acquired in real-time by the video cameras, the processor performs edge element detection, determining the magnitude of vertical and horizontal edge element intensities for each pixel of the image. Then, a vector with magnitude and angle is computed for each pixel from the horizontal and vertical edge element intensity data. Fuzzy set theory is applied to the vectors in a region of interest to fuzzify the angle and location data, as weighted by the magnitude of the intensities. Data from applying the fuzzy set theory is used to create a single vector characterizing the entire region of interest. Finally, a neural network analyzes the single vector and classifies the vehicle.

When machine vision systems analyze images, it is preferable to determine what areas of the image contains the interesting information at a particular time. By differentiating between areas within the entire image, a portion of the image can be analyzed to determine the importance of the information therein. One way to find the interesting information is to divide the acquired image into regions and specific regions of interest may be selected which meet predetermined criteria. In the traffic management context, another way to predetermine what areas of the image will usually contain interesting information is to note where the roadway is in the image and where the lane boundaries are within the roadway. Then, areas off the roadway will usually contain less information relevant to traffic management, except in extraordinary circumstances, such as vehicles going off the road, at which time the areas off the roadway will contain the most relevant information. One way to delineate the roadway in machine vision systems is to manually place road markers on the edges of the roadway. Then, a computer operator can enter the location of the markers on the computer screen and store the locations to memory. This method, however, requires considerable manual labor, and is particularly undesirable when there are large numbers of installations.

Another problem that machine vision systems face arises when attempting to align consecutive regions of interest. Typically, translation variant representations of regions of interest, or images, are acquired by the machine vision system. Therefore, alignment of these translation variant representations can be difficult, particularly when the detected or tracked object is not traveling in a straight line. When the edges of the roadway and the lane boundaries are delineated, however, it facilitates alignment of consecutive regions of interest because when the tracked object is framed, it becomes more translationally invariant. In the traffic management context, regions can be centered over the center of each lane to facilitate framing the vehicle within the regions, thereby making the representations of the regions of interest more translationally invariant.

SUMMARY OF THE INVENTION

The present invention provides a method and system for automatically defining boundaries of a roadway and the lanes therein from images provided by real-time video. A video camera provides images of a roadway and the vehicles traveling thereon. Motion is detected within the images and a motion image is produced representing areas where motion has been measured. Edge detection is performed in the motion image to produce an edge image. Edges parallel to the motion of the vehicle are located within the edge image and curves based on the parallel edges are generated, thereby defining a roadway or lane.

BRIEF DESCRIPTION OF THE DRAWINGS

The present invention will be more fully described with reference to the accompanying drawings wherein like reference numerals identify corresponding components, and:

FIG. 6 shows an edge image derived from the motion image shown in FIG. 3*c;*

FIG. 7 shows a cross section across a row in the image, showing the intensity for pixels in a column;

FIG. 10 shows four points representing the edge of the lane boundary and is used to explain how tangents may be determined for piecewise cubic spline curve interpolation.

DETAILED DESCRIPTION OF A PREFERRED EMBODIMENT

In the following detailed description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 1:
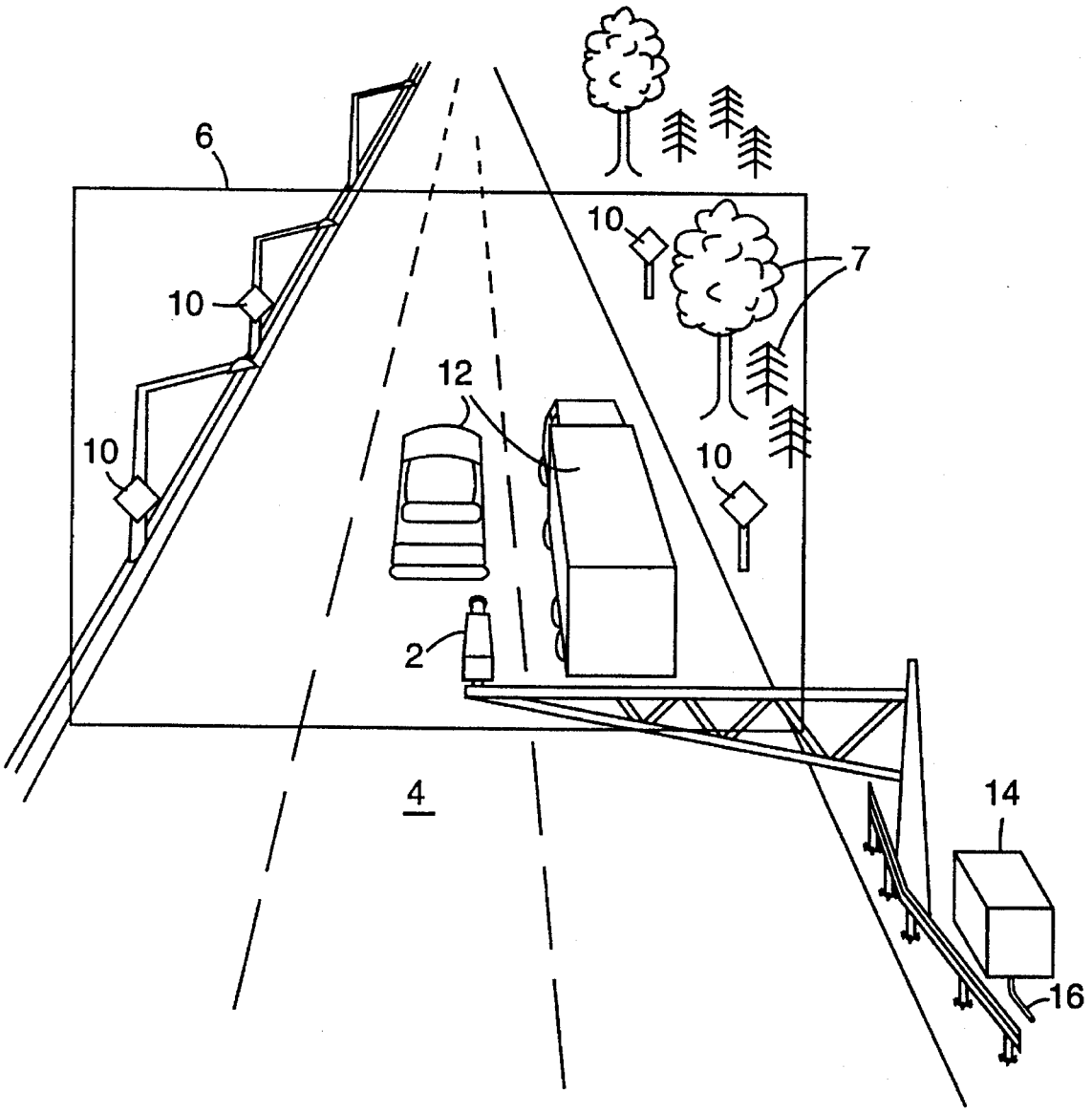
FIG. 1 shows a perspective view of a roadway with a video camera acquiring images for processing.

FIG. 1 shows a typical roadway scene with vehicles 12 driving on roadway 4. Along the side of roadway 4 are trees 7 and signs 10. Roadway 4 is monitored by a machine vision system for traffic management purposes. The fundamental component of information for a machine vision system is the image array provided by a video camera. The machine vision system includes video camera 2 mounted above roadway 4 to acquire images of a section of roadway 4 and vehicles 12 that drive along that section roadway 4. Moreover, within the boundaries of image 6 acquired by video camera 2, other objects are seen, such as signs 10 and trees 7. For traffic management purposes, the portion of image 6 that includes roadway 4 typically will contain more interesting information, more specifically, the information relating to the vehicles driving on the roadway, and the portions of the image that does not include roadway 4 will contain less interesting information, more specifically, information relating to the more static background objects.

Video camera 2 is electrically coupled, such as by electrical or fiber optic cables, to electronic processing or power equipment 14 located locally, and further may transmit information along interconnection line 16 to a centralized location. Video camera 2 can thereby send real-time video images to the centralized location for use such as viewing, processing or storing. The image acquired by video camera 2 may be, for example, a 512×512 pixel three color image array having an integer number defining intensity with a definition range for each color of 0-255. Video camera 2 may acquire image information in the form of digitized data, as previously described, or in an analog form. If image information is acquired in analog form, a image preprocessor may be included in processing equipment 14 to digitize the analog image information.

Figure 2:
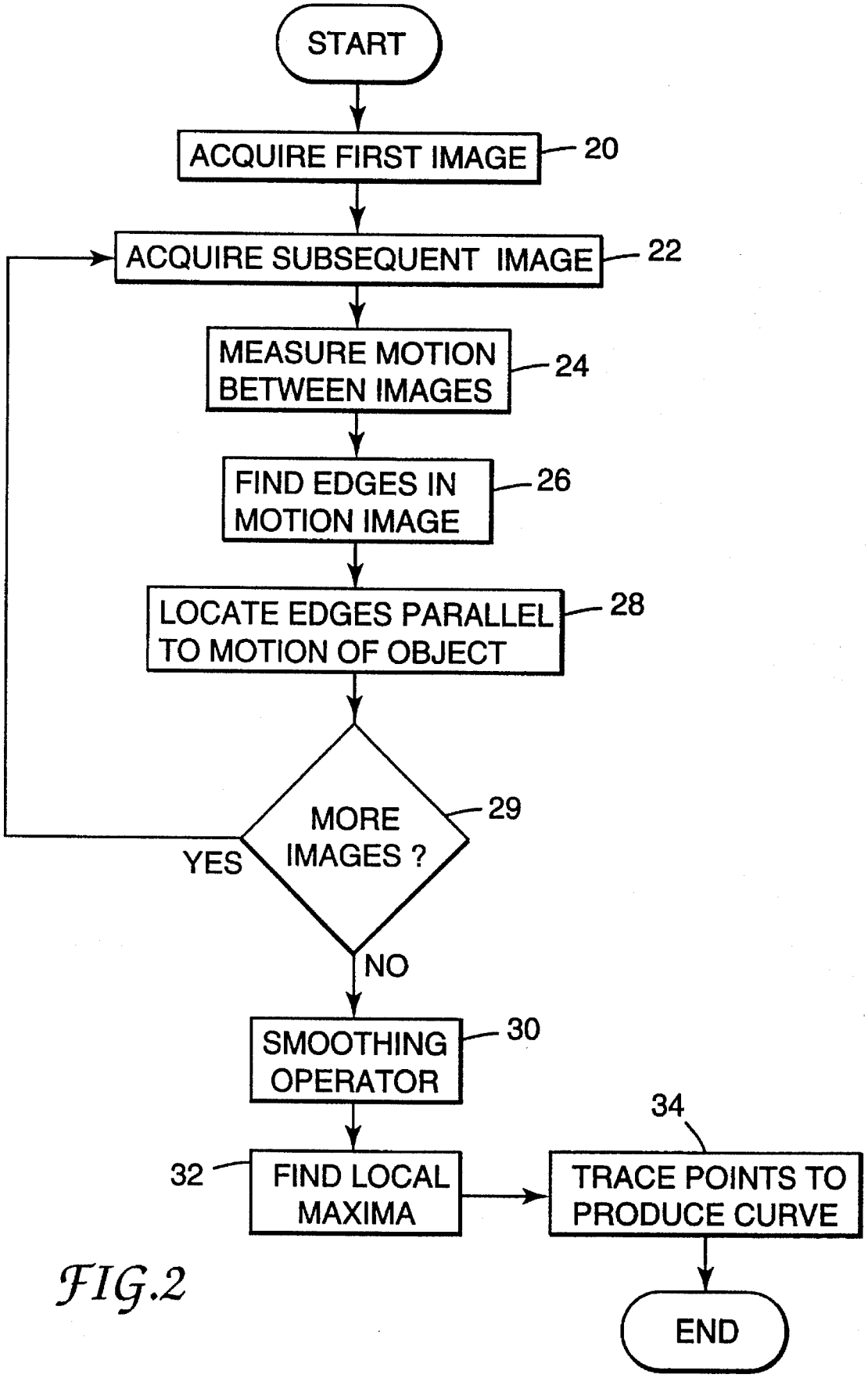
FIG. 2 is a flow diagram showing the steps of producing a curve defining boundaries of a roadway and lanes therein.

FIG. 2 shows a method for determining the portion of the image in which the roadway runs and for delineating the lanes within the roadway in real-time. This method analyzes real-time video over a period of time to make the roadway and lane determinations. In another embodiment, however, video of the roadway may be acquired over a period of time and the analysis of the video may be performed at a subsequent time. Referring to FIG. 2, after a first image is acquired at block 20 by video camera 2, a second image is acquired at block 22. As earlier described, each image is acquired in a digital format, or alternatively, in an analog format and converted to a digital format, such as by an analog-to-digital converter.

As a sequence of images over time are acquired and analyzed, three variables may be used to identify a particular pixel, two for identifying the location of the pixel within an image array, namely (i, j), where i and j are the coordinates of the pixel within the array, and the third being the time, t. The time can be measured in real-time or more preferably, can be measured by the frame number of the acquired images. For a given pixel (i, j, t), a corresponding intensity, I(i, j, t), exists representing the intensity of a pixel located at the space coordinates (i, j) in frame t, in one embodiment the intensity value being an integer value between 0 and 255.

Figure 3A:
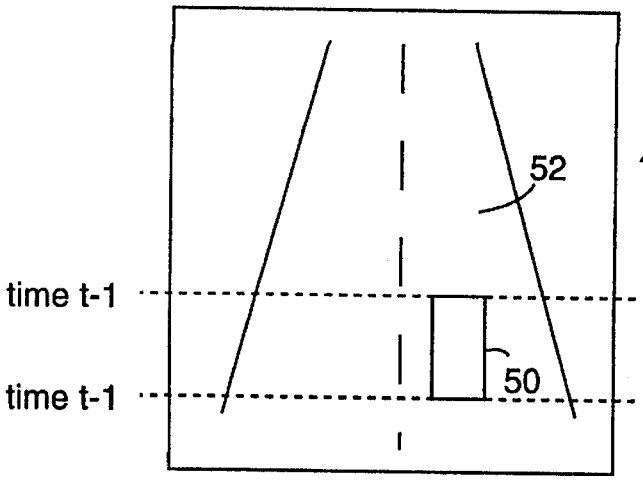
FIGS. 3*a* and 3*b* show raw images of a moving vehicle at a first time and a second time.
Figure 3B:
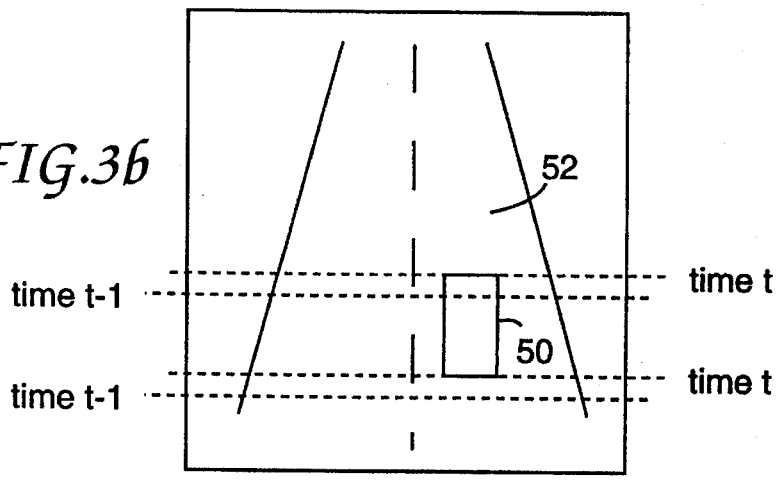
Figure 3C:
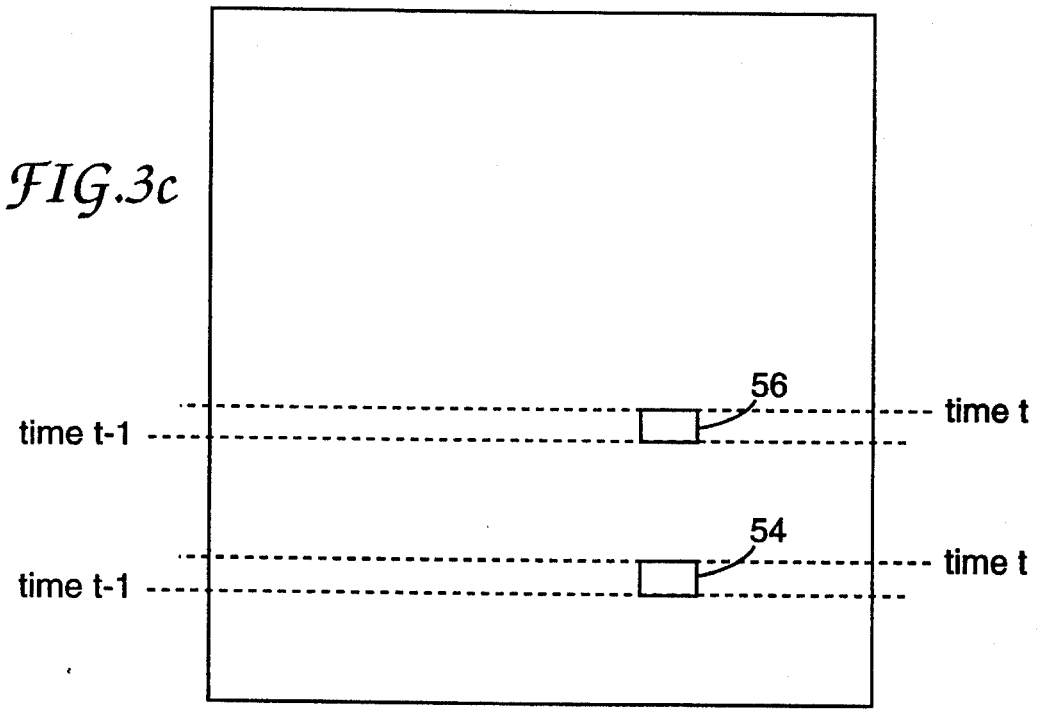
FIG. 3*c* shows a motion image derived from the images shown in FIGS. 3*a* and 3*b;*

At block 24, the change in pixel intensities between the first image and second image is measured, pixel-by-pixel, as a indication of change in position of objects from the first image to the second image. While other methods may be used to detect or measure motion, in a preferred embodiment, motion is detected by analyzing the change in position of the object. FIGS. 3*a*, 3*b* and 3*c* graphically show what change in position is being measured by the system. FIG. 3*a* depicts a first image acquired by the system, the image showing vehicle 50 driving on roadway 52, and located at a first position on roadway 52 at time t-1. FIG. 3*b* depicts a second image acquired by the system, the image showing vehicle 50 driving on roadway 52, and located at a second position on roadway 52 at time t. Because vehicle 50 has moved a distance between times t-1 and t, a change in position should be detected in two areas. FIG. 3*c* depicts a motion image, showing the areas where a change in pixel intensities has been detected between times t-1 and t, thereby inferring a change in position of vehicle 50. When vehicle 50 moves forward in a short time interval, the back of the vehicle moves forward and the change in pixel intensities, specifically from the vehicle's pixel intensities to the background pixel intensities, infers that vehicle 50 has had a change in position, moving forward a defined amount, which is represented in FIG. 3*c* as first motion area 54. The front of vehicle 50 also moves forward and the change in pixel intensities, specifically from the background pixel intensities to the vehicle's pixel intensities, also infers that vehicle 50 has had a change in position, as shown in second motion area 56. As can be seen in FIG. 3*c*, the areas between first motion area 54 and second motion area 56 have substantially no change in pixel intensities and therefore infers that there has been substantially no motion change. In a preferred embodiment, the motion image may be determined by the following equation:

$$M(i, j, t) \equiv \left| \frac{\partial I(i, j, t)}{\partial t} \right| \equiv |I(i, j, t) - I(i, j, t-1)|$$

which is the partial derivative of the intensity function I(i, j, t) with respect to time, and which may be calculated by taking the absolute value of the difference of the intensities of the corresponding pixels of the first image and the second image. The absolute value may be taken to measure positive changes in motion.

Referring back to FIG. 2, at block 26, the motion image is analyzed to identify edge elements within the motion image. An edge element represents the likelihood a particular pixel lies on an edge. To determine the likelihood that a particular pixel lies on an edge, the intensities of the pixels surrounding the pixel in question are analyzed. In one embodiment, a three-dimensional array of edge element values make up an edge image and are determined by the following equation:

$$E(i,j,t) \equiv 8M(i,j,t) - \sum_{i\pm1}\sum_{j\pm1} M(i,j,t)$$

Figure 4:
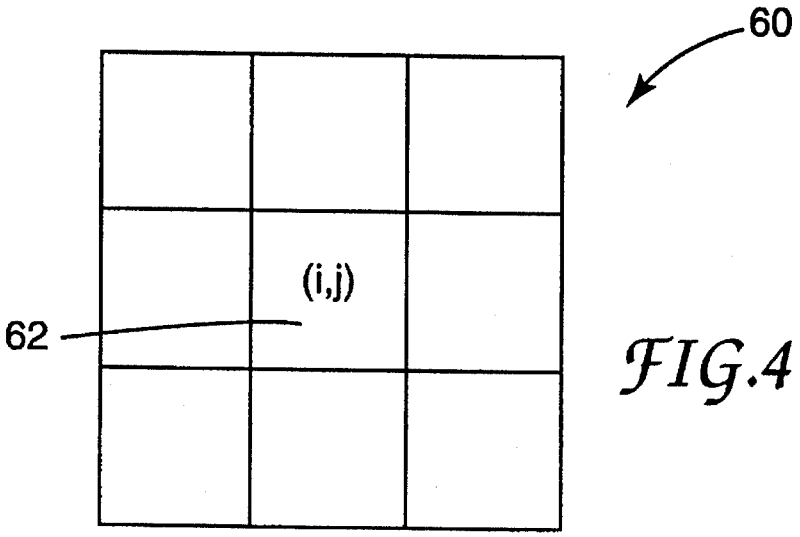
FIG. 4 shows a 3×3 portion of a motion image.

FIG. 4 shows 3×3 portion 60 of a motion image. To determine E(i, j, t) for pixel (i, j), the pixel intensity value of pixel in question 62 in the motion image M(i, j, t) is first multiplied by eight. Then, the intensity value of each of the eight neighboring pixels is subtracted from the multiplied value. After the eight subtractions, if pixel in question 62 is not on an edge, the intensity values of pixel 62 and its neighboring pixels are all approximately equal and the result of E(i, j, t) will be approximately zero. If pixel 62 is on an edge, however, the pixel intensities will be different and a E(i, j, t) will produce a non-zero result. More particularly, E(i, j, t) will produce a positive result if pixel 62 is on the side of an edge having higher pixel intensities and a negative result if pixel 62 is on the side of an edge having lower pixel intensities.

Figure 5A:
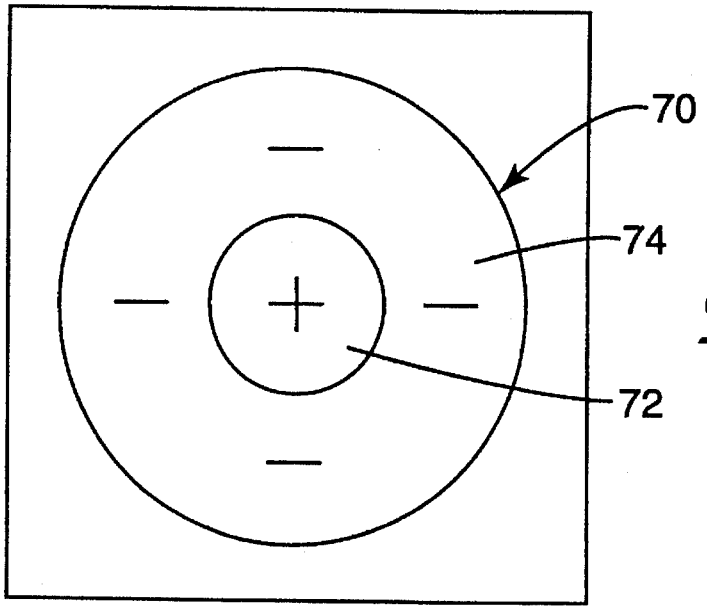
FIGS. 5*a* and 5*b* show a top view and a side view of a Mexican Hat filter.
Figure 5B:
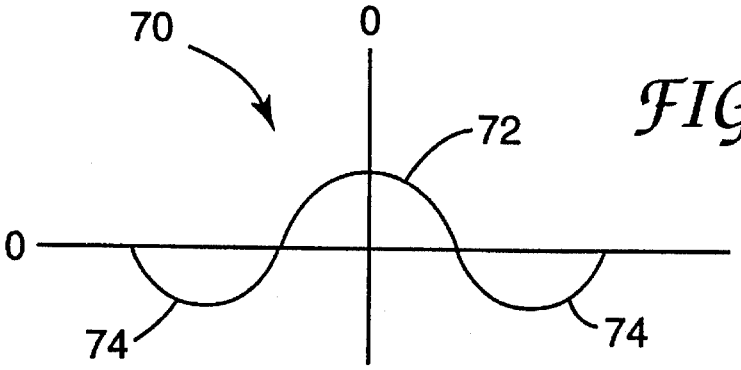

In another embodiment, a Mexican Hat filter may be used to determine edges in the motion image. FIGS. 5*a* and 5*b* show a top view and a side view representing a Mexican Hat filter that may be used with the present invention. Mexican Hat filter 70 has a positive portion 72 and a negative portion 74 and may be sized to sample a larger or smaller number of pixels. Filter 70 is applied to a portion of the motion image and produces an edge element value for the pixel over which the filter is centered. A Mexican Hat filter can be advantageous because it has a smoothing effect, thereby eliminating spurious variations within the edge image. With the smoothing, however, comes a loss of resolution, thereby blurring the image. Other filters having different characteristics may be chosen for use with the present invention based on the needs of the system, such as different image resolution or spatial frequency characteristics. While two specific filters have been described for determining edges within the motion image, those skilled in the art will readily recognize that many filters well known in the art may be used for with the system of the present invention and are contemplated for use with the present invention.

To determine the edges of the roadway, and to determine the lane boundaries within the roadway, the relevant edges of the vehicles traveling on the roadway and within the lane boundaries are identified. The method of the present invention is based on the probability that most vehicles moving through the image will travel on the roadway and within the general lane boundaries. At block 28 of FIG. 2, edges parallel to the motion of the objects, specifically the vehicles traveling on the roadway, are identified. FIG. 6 shows edge image E(i, j, t), which has identified the edges from motion image M(i, j, t) shown in FIG. 3*c*. Perpendicular edges 80 are edges perpendicular to the motion of the vehicle. Perpendicular edges 80 change from vehicle to vehicle and from time to time in the same vehicle as the vehicle move. Therefore, over time, summing perpendicular edges results in a value approximately zero. Parallel edges 82, however, are essentially the same from vehicle to vehicle, as vehicles are generally within a range of widths and travel within lane boundaries. If the edge images were summed over time, pixels in the resulting image that corresponded to parallel edges from the edge images would have high intensity values, thereby graphically showing the lane boundaries.

Once all the parallel edges are located between the two images, the system checks if subsequent images must be analyzed at block 29. For example, the system may analyze all consecutive images acquired by the video cameras, or may elect to analyze one out of every thirty images. If subsequent images to be analyzed exist, the system returns to block 22 and compares it with the previously acquired image. Once no more images need to be analyzed, the system uses the information generated in blocks 24, 26 and 28 to determine the edges of the roadway and lanes.

The following transform, F(i, j), averages the edge image values E(i, j, t) over time, t:

$$F(i, j) \equiv \frac{\int E(i, j, t)dt}{t_{final} - t_{initial}}$$

Figure 8:
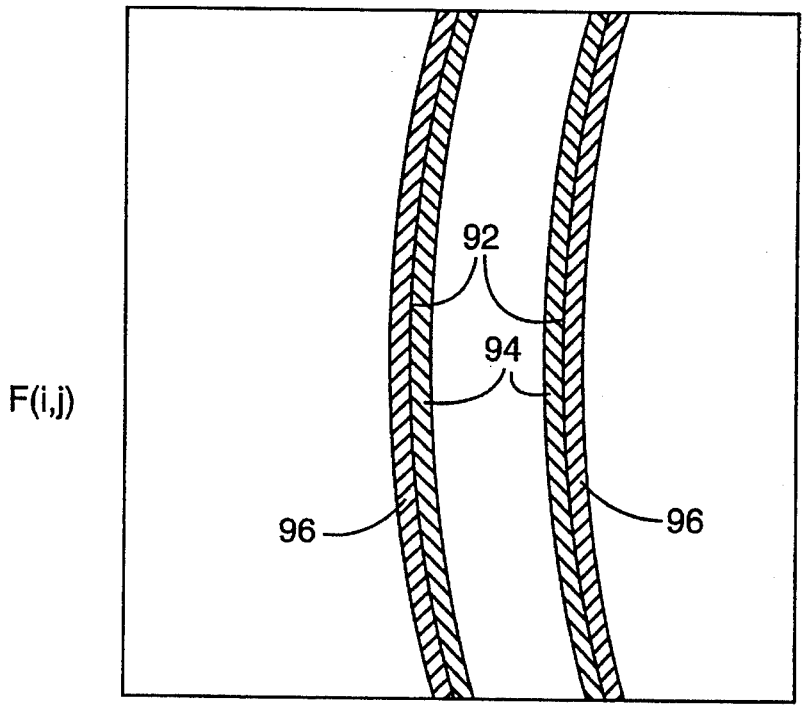
FIG. 8 shows an image produced when images like the image in FIG. 7 are summed over time.
Figure 9:
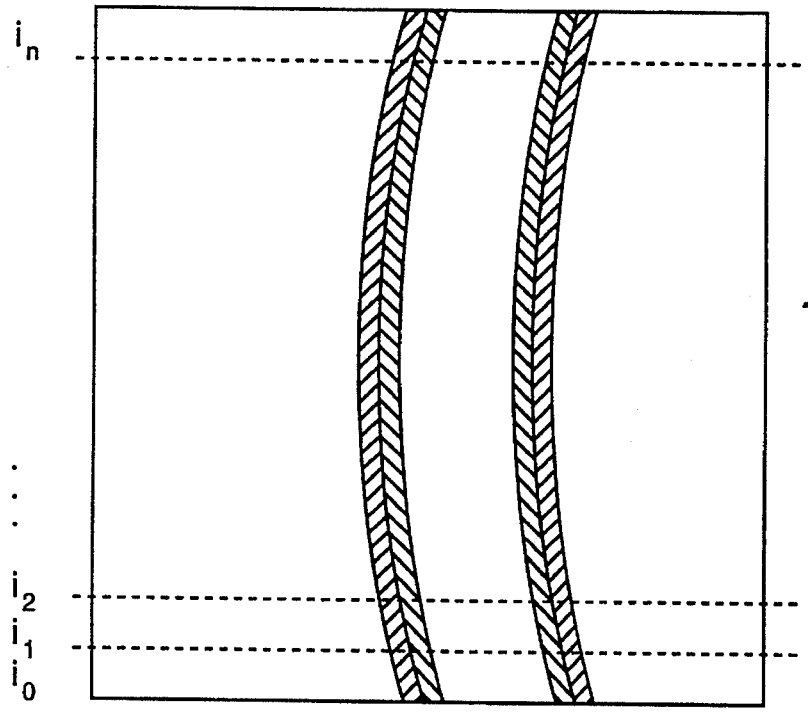
FIG. 9 is used to show how to fix rows to produce points representing the edge of the lane boundary.

FIG. 7 shows the cross section across a row, i, showing the intensity for pixels in column, j. The portion of F(i) between peaks 84 and valleys 86 of F(i) represent the edges of the lane. When the edge images are summed over time, as shown in FIG. 8, lane boundaries 92 can be seen graphically, approximately as the line between the high intensity values 94 and the low intensity values 96 of F(i, j). While the graphical representation F(i, j) shows the lane boundaries, it is preferable to have a curve representing the lane boundaries, rather than a raster representation. A preferred method of producing a curve representing the lane boundaries is to first apply a smoothing operator to F(i, j), then identify points that define the lanes and finally trace the points to create the curve defining the lane boundaries. At block 30 of FIG. 2, a smoothing operator is applied to F(i, j). One method of smoothing F(i, j) is to fix a number of i points, or rows. For roadways having more curvature, more rows must be used as sample points to accurately define the curve while roadways with less curvature can be represented with less fixed rows. FIG. 9 shows F(i, j) with r fixed rows, $i_0$-$i_r$. Across each fixed row, i, the local maxima of the row are located at block 32. More specifically, across each fixed row, points satisfying the following equations are located:

$$\frac{\partial F^2(n, j)}{\partial j^2} < 0 \text{ and } \frac{\partial F(n, j)}{\partial j} = 0$$

The equations start at the bottom row of the n by m image and locate local maxima in row n. Local maxima are identified in subsequent fixed rows, which may be determined by setting a predetermined number, r, of fixed rows for an image, resulting in r points per curve or may be determined by locating local maxima every k rows, resulting in n/k points per curve. The points satisfying the equations trace and define the desired curves, one curve per lane boundary. For a multiple number of lanes, each pair of local maxima can define a lane boundary. Further processing may be performed for multiple lanes, such as interpolating between adjacent lane boundaries to define a single lane boundary between two lanes.

At block 34, the points located in block 32 are traced to produce the curves defining the lane boundaries. The tracing is guided by the constraint that the curves run approximately parallel with allowances for irregularities and naturally occurring perspective convergence. A preferred method of tracing the points to produce the curves is via cubic spline interpolation. Generating a spline curve is preferable for producing the curve estimating the edge of the road because it produces a smooth curve that is tangent to the points located along the edge of the road and lanes. Those skilled in the an will readily recognize that many variations of spline curves may be used, for example, piecewise cubic, Bessier curves, B-splines and non-uniform rational B-splines. For example, a piecewise cubic spline curve can interpolate between four chords of the curve or two points and two tangents. FIG. 10 shows four points, points $P_{i-1}$, $P_i$, $P_{i+1}$, and $P_{i+2}$. A cubic curve connecting the four points can be determined by solving different simultaneous equations to determine the four coefficients of the equation for the cubic curve. With two points, $P_i$ and $P_{i+1}$, the values of the two points and two tangents can be used to determine the coefficients of the equation of the curve between $P_i$ and $P_{i+1}$.

The tangent of point $P_i$ may be assigned a slope equal to the secant of points $P_{i-1}$ and $P_{i+1}$. For example, in FIG. 10, the slope of tangent 104 is assigned a slope equal to secant 102 connecting points $P_{i-1}$ and $P_{i+1}$. The same can be done for point $P_{i+1}$. Further, the tangents on both sides of the lane may be averaged to get a uniform road edge tangent, such that the road is of substantially uniform width and curvature. The resulting composite curve produced by this method is smooth without any discontinuities.

Although a preferred embodiment has been illustrated and described for the present invention, it will be appreciated by those of ordinary skill in the art that any method or apparatus which is calculated to achieve this same purpose may be substituted for the specific configurations and steps shown. This application is intended to cover any adaptations or variations of the present invention. Therefore, it is manifestly intended that this invention be limited only by the appended claims and the equivalents thereof.

What is claimed is:

1. A system for defining the boundaries of a roadway and lanes therein, said system comprising:

image acquisition means for acquiring images of said roadway and objects traveling thereon;

means for measuring motion of said objects between said images and for producing a motion image representing measured motion;

edge detection means for detecting edges within said motion image and for producing an edge image;

means for locating parallel edges within said edge image, said parallel edges representing edges of said objects parallel to the motion of said objects; and means for generating curves based on said parallel edges, wherein said generated curves are indicative of the boundaries of the roadway and the lanes therein.

2. The system according to claim 1, wherein said means for generating the curves comprises:

means for summing a plurality of edge images over time to produce a summed image;

means for locating local maxima of a plurality of fixed rows within said summed image; and means for tracing said local maxima to produce a plurality of substantially parallel curves.

3. The system according to claim 1, wherein said image acquisition means comprises a video camera.

4. The system according to claim 1, wherein said means for measuring motion between said images measures a change in position of said objects between said images.

5. The system according to claim 1, wherein said edge detection means comprises a filter for comparing pixel intensities over space.

6. The system according to claim 2, wherein said means for tracing said local maxima comprises means for performing cubic spline interpolation.

7. A method for defining the boundaries of a roadway and lanes therein within images, said images acquired by a machine vision system, said method comprising the steps of:

measuring motion of objects between said images;

producing a motion image representing said measured motion based on said step of measuring motion;

detecting edges within said motion image;

producing an edge image based on said step of detecting edges;

locating parallel edges within said edge image, said parallel edges representing edges of said objects parallel to the motion of said objects; and generating curves based on said parallel edges, wherein said generated curves are indicative of the boundaries of the roadway and the lanes therein.

8. The method according to claim 7, wherein said step of generating curves based on said parallel edges comprises the steps of:

summing a plurality of edge images over time to produce a summed image;

locating local maxima of a plurality of fixed rows within said summed image; and tracing said local maxima to produce a plurality of substantially parallel curves.

9. The method according to claim 7, wherein said step of measuring motion between said images measures a change in position of said objects between said images.

10. The method according to claim 8, wherein said step of tracing said local maxima comprises performing cubic spline interpolation.

* * * * *

UNITED STATES PATENT AND TRADEMARK OFFICE

CERTIFICATE OF CORRECTION

PATENT NO.: 5,621,645

DATED: April 15, 1997

INVENTOR(S): Mark J. Brady

It is certified that error appears in the above-identified patent and that said Letters Patent is hereby corrected as shown below:

Column 3, line 48, delete "a" and insert therefore –an--.

Column 4, line 10, delete "a" and insert therefore –an--.

Column 5, line 32, delete "for".

Column 5, line 49, delete "move" and insert therefore –moves--.

Column 6, line 56, delete "in the an" and insert therefore –in the art--.

Signed and Sealed this

Thirteenth Day of January, 1998

Bruce Lehman

*Attest:*

BRUCE LEHMAN

*Attesting Officer*

*Commissioner of Patents and Trademarks*